US008187036B2

(12) United States Patent
Fujiwara et al.

(10) Patent No.: US 8,187,036 B2
(45) Date of Patent: May 29, 2012

(54) SHIELD CONNECTOR

(75) Inventors: Michiyo Fujiwara, Yokkaichi (JP); Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/004,222

(22) Filed: Jan. 11, 2011

(65) Prior Publication Data

US 2011/0171855 A1 Jul. 14, 2011

(30) Foreign Application Priority Data

Jan. 14, 2010 (JP) ..... 2010-005815

(51) Int. Cl.
*H01R 13/648* (2006.01)

(52) U.S. Cl. ..... 439/607.47; 439/607.41; 439/578

(58) Field of Classification Search ..... 439/607.41, 439/607.42, 607.45, 607.47, 607.48, 607.5, 439/607.51, 98, 57, 8
See application file for complete search history.

(56) References Cited

U.S. PATENT DOCUMENTS

| | | | | |
|---|---|---|---|---|
| 5,429,529 | A * | 7/1995 | Hashizawa et al. | 439/607.5 |
| 5,618,190 | A * | 4/1997 | Masuda et al. | 439/98 |
| 5,911,599 | A * | 6/1999 | Masuda | 439/607.58 |
| 5,931,698 | A * | 8/1999 | Kodama | 439/578 |
| 5,997,349 | A * | 12/1999 | Yoshioka | 439/579 |
| 6,270,377 | B1 * | 8/2001 | Miyazaki et al. | 439/607.41 |
| 6,491,530 | B2 * | 12/2002 | Koide et al. | 439/92 |
| 6,533,615 | B2 * | 3/2003 | Koide et al. | 439/607.48 |
| 6,554,623 | B2 * | 4/2003 | Yoshioka | 439/98 |
| 6,749,464 | B2 * | 6/2004 | Obata | 439/607.41 |
| 6,796,838 | B2 * | 9/2004 | Yoshioka | 439/607.01 |
| 6,887,106 | B2 * | 5/2005 | Noguchi et al. | 439/607.56 |
| 7,081,016 | B2 * | 7/2006 | Tateno | 439/585 |
| 7,204,716 | B1 * | 4/2007 | George et al. | 439/607.41 |
| 7,344,413 | B2 * | 3/2008 | Nishida | 439/607.41 |
| 7,351,098 | B2 * | 4/2008 | Gladd et al. | 439/578 |
| 7,485,002 | B2 * | 2/2009 | Nishide et al. | 439/607.17 |
| 7,597,563 | B2 * | 10/2009 | Shinkawa et al. | 439/98 |
| 7,731,536 | B2 * | 6/2010 | Okayasu | 439/607.51 |
| 2002/0042228 | A1 * | 4/2002 | Yoshioka | 439/610 |
| 2002/0106917 | A1 * | 8/2002 | Koide et al. | 439/92 |
| 2003/0008555 | A1 * | 1/2003 | Obata | 439/578 |
| 2005/0070158 | A1 * | 3/2005 | Tateno | 439/581 |
| 2008/0119087 | A1 * | 5/2008 | Nishide et al. | 439/607 |
| 2009/0035993 | A1 * | 2/2009 | Okayasu | 439/610 |
| 2011/0171855 | A1 * | 7/2011 | Fujiwara et al. | 439/607.41 |
| 2011/0195603 | A1 * | 8/2011 | Fujiwara et al. | 439/607.28 |
| 2011/0230086 | A1 * | 9/2011 | Fujiwara et al. | 439/559 |

FOREIGN PATENT DOCUMENTS

JP 7-263082 10/1996

* cited by examiner

*Primary Examiner* — Ross Gushi

(74) *Attorney, Agent, or Firm* — Gerald E. Hespos; Michael J. Porco

(57) ABSTRACT

A shield connector is provided with terminal fittings (10) having shield cables (11) connected thereto, a connector housing (20), into which the terminal fittings (10) are to be mounted, a shield shell (40) to be accommodated into the connector housing (20), and resilient pieces (45) each including a contact portion (47) which is provided on the shield shell (40) and comes into contact with a connection portion (19B) of the shield cable (11). Each resilient piece (45) includes projecting pieces (49) for preventing the resilient piece (45) from being excessively deformed by coming into contact with restricting portions (38) provided in the connector housing (20).

8 Claims, 8 Drawing Sheets

SHIELD CONNECTOR

BACKGROUND OF THE INVENTION

1. Field of the Invention

The invention relates to a shield connector provided with a shield shell in a housing.

2. Description of the Related Art

Japanese Unexamined Patent Publication No. H07-263082 discloses a conventional shield connector with a metallic shield shell in a housing. Two resilient pieces are formed at an end portion of the shield shell for resiliently sandwiching a connection portion of shield braided wire of a shield cable. A terminal fitting having the shield cable connected thereto is mounted into the housing so that the connection portion is fit between the resilient pieces. Thus, the shield shell in the housing is connected electrically to the braided wire of the shield cable.

However, the terminal fitting having the shield cable connected thereto could be inserted off center or obliquely into the housing. Thus, the terminal fitting or the connection portion of the shield cable can contact rear projecting portions of the resilient pieces. The resilient pieces then are pushed into an arrangement space where the connection portion of the shield cable is to be held and plastically deformed.

The invention was developed in view of the above situation and an object thereof is to prevent a resilient piece from being excessively deformed and/or plastically deformed when a terminal fitting having a shield cable connected thereto is inserted into a housing.

SUMMARY OF THE INVENTION

The invention relates to a shield connector with at least one terminal fitting to be connected with a shield cable. The connector also has a housing in which the terminal fitting is mounted. At least one conductive shield shell is accommodated in the housing to substantially surround the terminal fitting and an end portion of the shield cable. At least one resilient piece extends from the shield shell, and at least one contact is formed on the resilient piece for contacting a connection portion on a shield portion of the shield cable. The connection portion contacts the contact of the resilient piece by mounting the terminal fitting into the housing. The resilient piece includes at least one touching portion that contacts at least one restriction on the housing for preventing the resilient piece from being deformed excessively toward an arrangement space for the connection portion.

The resilient piece preferably extends substantially back from the rear edge of the shield shell and is folded or bent.

A terminal fitting mounted on a shield cable may be assembled into a conventional connector housing. As a result, the terminal fitting or the connection portion on the shield cable may contact a rear projection of the resilient piece. Thus, the resilient piece may be pushed toward the arrangement space for the connection portion of the shield cable and may be deformed plastically. However, the resilient piece of the connector of the invention is not deformed excessively by the contact of the contact portion with the restriction of the housing and will not be deformed plastically.

The touching portion preferably projects from opposite lateral portions of the resilient piece. Thus, the touching portion can more easily come into contact with the restriction of the housing and excessive deformation of the resilient piece is prevented more reliably by providing the touching portion at the opposite lateral portions of the resilient piece.

Two resilient pieces preferably are provided at a position to be united with a supporting frame body in the housing and substantially face each other. The connection portion of the shield cable is held between the two resilient pieces so that a more reliably electrically conductively connection is achieved between the resilient pieces and the shield shell when the terminal fitting is mounted.

A distance between the contact portions preferably is slightly less than an outer diameter of a shell ring mounted on the shield cable. Thus, the connection portion is sandwiched resiliently by the contact portions of the resilient pieces when the terminal fitting is mounted correctly in the housing.

The resilient piece preferably comprises a folded or bent portion folded or bent back to project from the resilient piece, and a folded piece preferably extends substantially straight forward from the folded portion.

A leading end of the folded piece preferably is bent toward the contact portion at a position outside the contact portion to prevent the contact portion from being pressed excessively out.

The touching portion preferably projects from opposite lateral portions of the resilient piece.

Two resilient pieces preferably are provided at positions to be united with a supporting frame body in the housing and substantially face each other.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
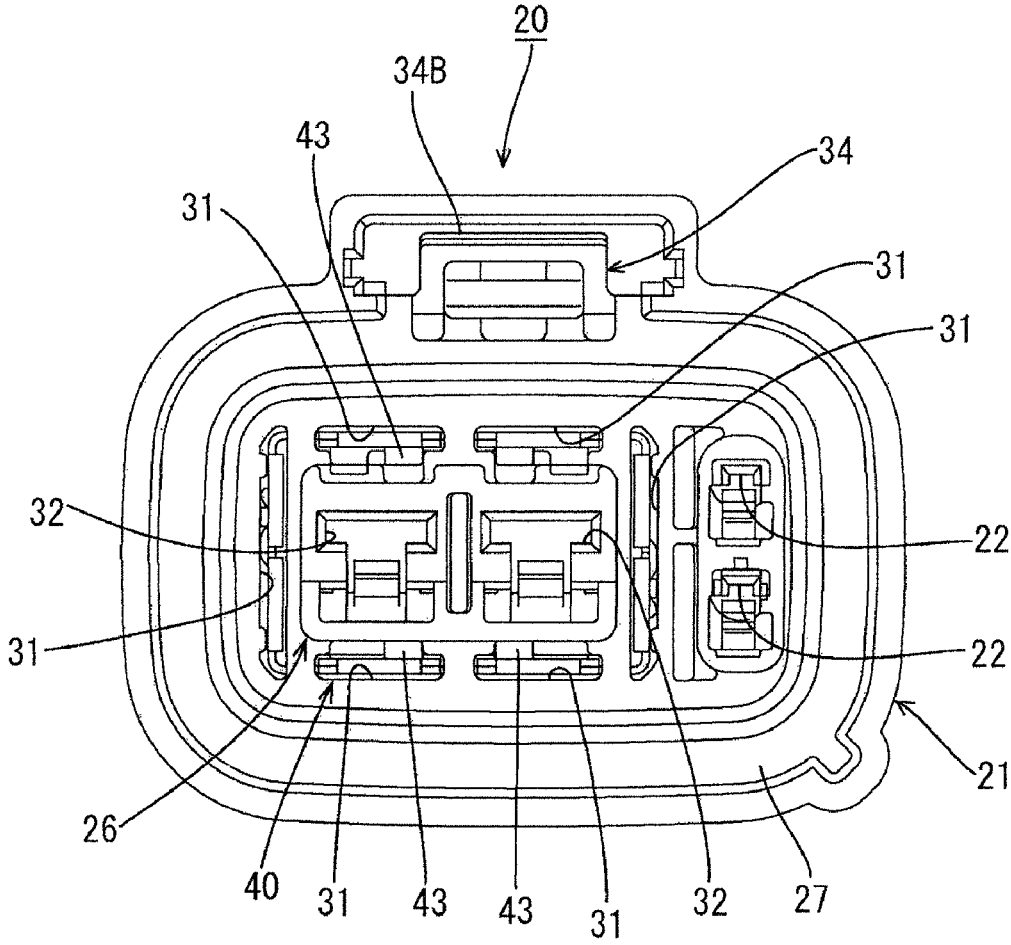
FIG. 1 is a front view of a housing of a connector according to one embodiment of the invention.
Figure 2:
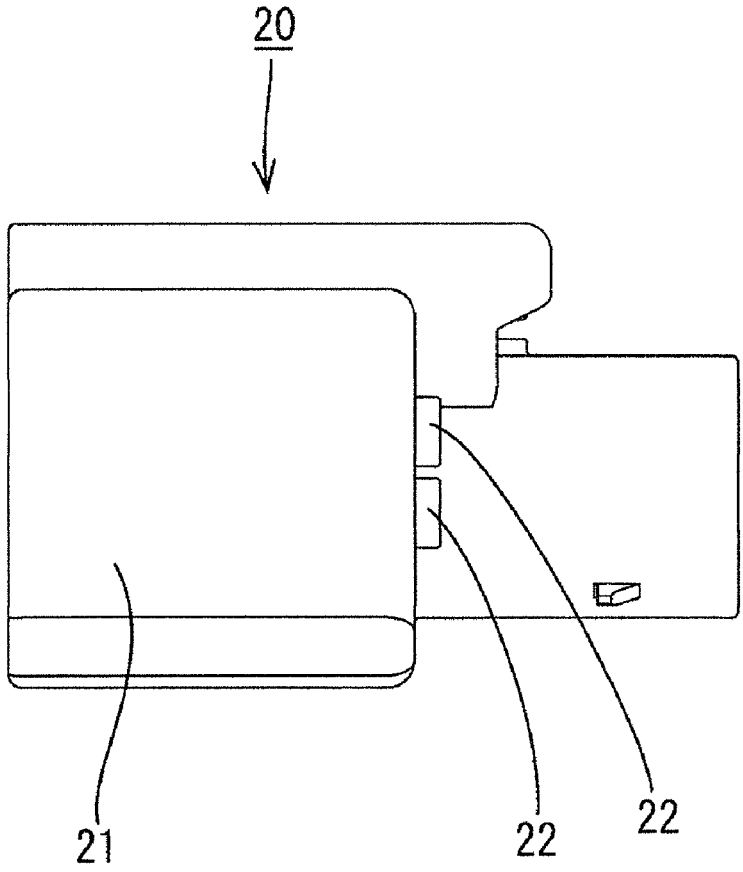
FIG. 2 is a side of the housing.
Figure 3:
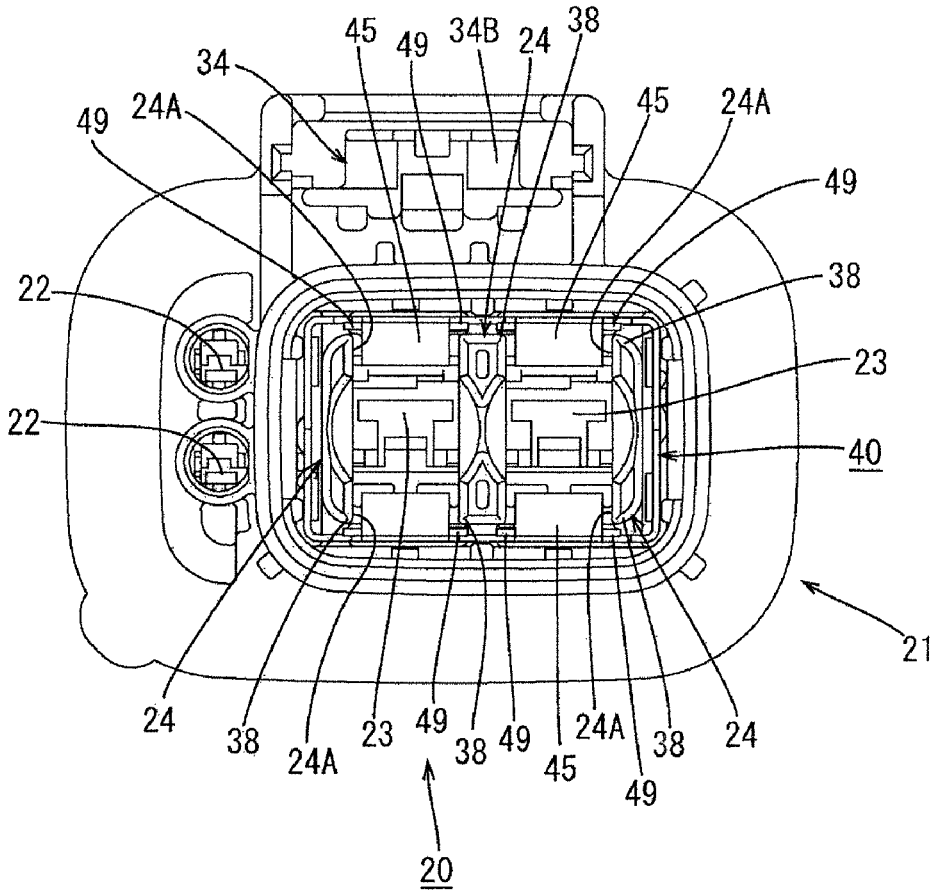
FIG. 3 is a rear view of the housing.
Figure 4:
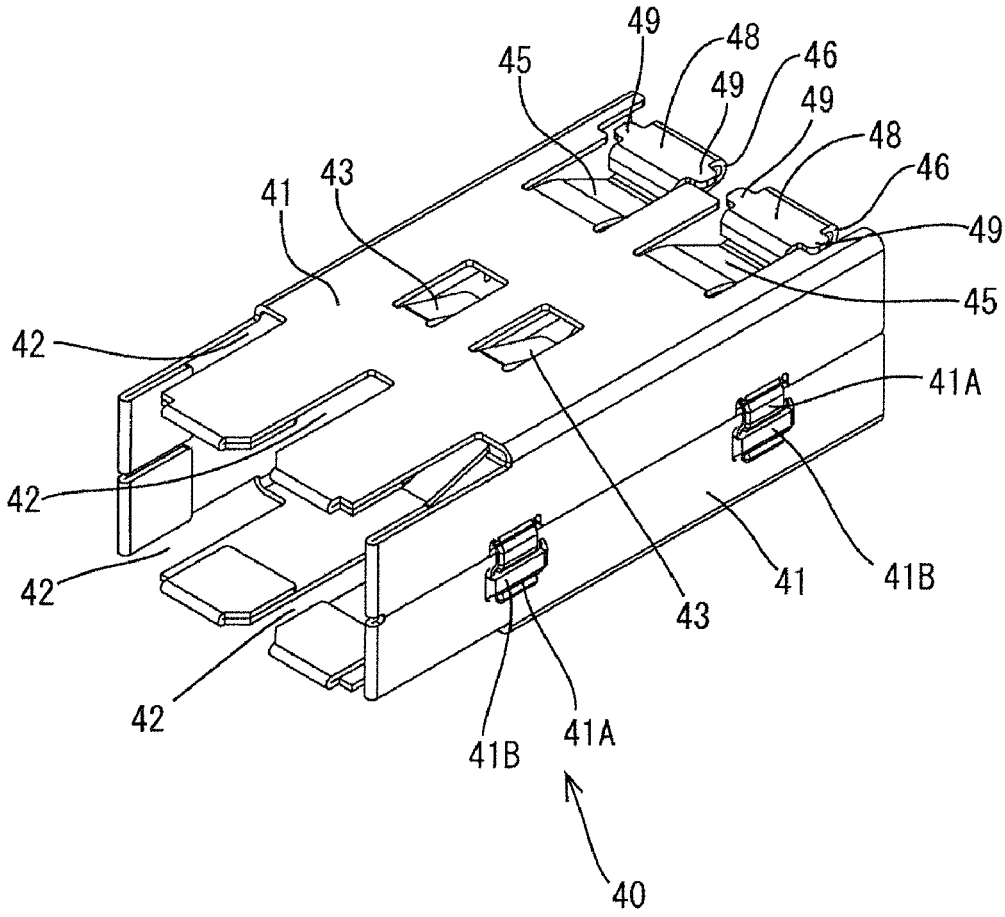
FIG. 4 is a perspective view of a shield shell.
Figure 5:
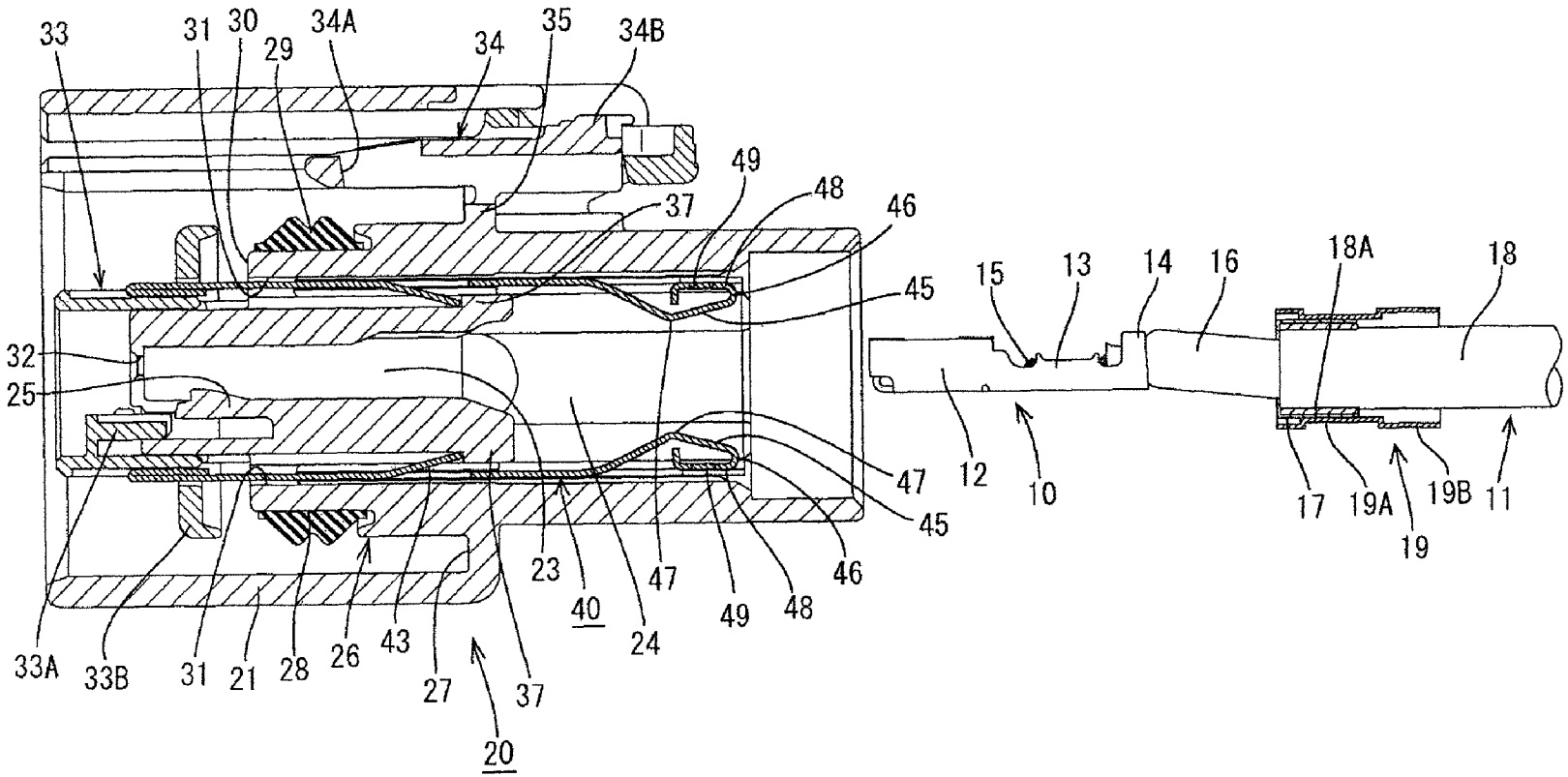
FIG. 5 is a side view in section showing a state before a terminal fitting is mounted into the housing.

A connector in accordance with the invention has female terminal fittings 10 to be connected to respective shield cables 11, a housing 20 made e.g. of synthetic resin, into which the terminal fittings 10 are to be mounted, and a conductive metallic shield shell 40 to be accommodated into or mounted to the housing 20. In the following description, "front" and "rear" refer to front and rear ends in an operating direction to connect the connector with a mating connector.

The terminal fitting 10 is formed with a rectangular tubular connecting portion 12 at a front end of the terminal fitting 10 and a tab-shaped terminal (not shown) mounted in the mating connector is to be connected with the connecting portion 12 from the front. A rear end of the terminal fitting 10 has wire connection barrels 13, 14 to be connected to a shield cable 11. The shield cable 11 includes a core 15 and an inner coating 16 outside the core 15. The inner coating 16 is covered by a braided wire shield 17 and an outer coating 18. The shield cable 11 is connected electrically to the terminal fitting 10 by crimping the barrel 13 of the terminal fitting 10 to an exposed part at an end of the core 15 and by crimping a crimping portion 19A provided in a central part of a conductive metallic shell ring 19 (in the form of a hexagonal or polygonal tube) to the folded-back braided wire 17 after stripping off the outer coating 18 at a position behind the exposed part of the core 15. Thus, the braided wire 17 and the shell ring 19 are connected electrically and the shell ring 19 is mounted on the shield cable 11. Further, an underlay ring 18A is mounted under the folded-back part of braided wire 17 beforehand so that a crimping force is not absorbed by the resiliency of the outer coating portion 18.

The housing 20 has a substantially rectangular parallelepipedic shape and its front and rear ends are open. A receptacle 21 is formed from an intermediate part to a front opening edge of the housing 20, and the outer wall of the receptacle 21 bulges out over substantially the entire periphery as compared with the other outer wall. Two cylindrical auxiliary terminal holes 22 are formed in a rear surface defined by the bulging shape of the receptacle 21 and extend back along the housing 20 to provide communication between the inner and outer sides of the receptacle 21.

The inner surface of the housing 20 located behind the receptacle 21 is slightly narrower at a position before a rear opening edge, and two cavities 23 are formed substantially side by side in a central part of the housing 20. The cavities 23 extend to the interior of the receptacle 21 and can receive the terminal fittings 10. A rear part of the cavities 23 has a supporting frame body 24 that is somewhat larger than a front part so as to allow insertion of the shell ring 19. The inner surface of the supporting frame body 24 defines a circular cross section, and the supporting frame body 24 is formed with a large opening 24A extending at an angle preferably a right angle to an arrangement direction of the cavities 23.

A resiliently deformable locking lance 25 projects from an inner surface of a front part of each cavity 23 and is adapted to lock the terminal fitting 10. The locking lance 25 is resiliently deformed out of the cavity 23 when the terminal fitting 10 is inserted through a rear opening edge. The locking lance 25 is freed from resilient deformation and engages the terminal fitting 10 when the terminal fitting 10 is inserted up to a specified position, thereby retaining the terminal fitting 10 in the connector housing 20.

The receptacle 21 has a fitting portion 26, into which a mating connector is to be fit. The fitting portion 26 is in an intermediate position of the interior of the receptacle 21, and projects substantially straight from a back wall 27 toward the front edge. The outer surface of the fitting portion 26 is narrowed in two steps from the back wall 27 to the front, and a seal mounting portion 28 is formed on a middle part of the outer surface of the fitting portion 26 for accommodating a seal 29 in a looped or stepped manner. A step 30 between the rear outer surface and the middle outer surface is formed with clearance holes 31 that extend substantially from the step 30 to the rear end of the receptacle 21 and penetrate through the back wall 27 of the receptacle 21. Two clearance holes 31 are formed substantially along each longer side of the fitting portion 26, and one clearance hole 31 is formed along each shorter side of the fitting portion 26, so that a total of six clearance holes 31 are formed along the four sides.

Terminal insertion holes 32 are formed side by side in the front end surface of the fitting portion 26 at positions displaced from the center and are configured to receive terminals of the mating housing. Ends of the auxiliary terminal holes 22 are formed in an area displaced laterally from the terminal insertion holes 32. Terminal fittings 10 are inserted in the fitting portion 26 and are engaged with respective locking lances 25. A retainer 33 then is mounted and includes a deformation restricting portion 33A for preventing the locking lances 25 from being deformed outwardly. The retainer 33 also has a stopping portion 33B for retaining the seal 29 on the seal mounting portion 28.

A lock 34 extends from a support 35 formed unitarily with the back wall 27 of the receptacle 21. An engaging portion 34A is formed at the front end of the lock 34 and substantially faces the fitting portion 26 in the receptacle 21. The engaging portion 34A can engage an engaging claw formed on the outer surface of the unillustrated mating connector when the mating connector is inserted into the receptacle 21. An operable portion 34B is formed at the rear end of the lock piece 34 and extends back from the receptacle 21 of the housing 20 to be exposed from the housing 20. The operable portion 34B can be pressed for resiliently deforming the lock piece 34 to cancel an engaged state with the mating connector.

The shield shell 40 is a substantially flat rectangular tube that is accommodated in the housing 20 so that a front part of the shield shell 40 substantially surrounds the fitting portion 26 of the housing 20 and a rear part of the shield shell 40 substantially surrounds the supporting frame bodies 24. A front end of the shield shell 40 is inserted through the clearance holes 31 of the housing 20 and is arranged substantially at the same position as the front end of the fitting portion 26. A rear end of the shield shell 40 is located before the rear end of the housing 20.

The shield shell 40 is formed by punching out both ends of rectangular metal plates with a press to bend the ends at right angles thereby forming two long narrow frame pieces 41 of substantially U-shaped cross section. The frame pieces 41 are positioned to face each other and are connected to form the shield shell 40 by inserting fitting pieces 41A on one frame piece 41 into fitting frames 41B on the other fitting piece 41B.

The leading end of a front part of the shield shell 40 surrounding the fitting portion 26 of the housing 20 is folded back. Front slits 42 extend substantially straight in forward and backward directions from the front opening edge of the shield shell 40 and have length equal to about ⅓ of the length of the shield shell 40. The front slits 42 are formed at middle and opposite side positions of each wider side panel of the shield shell 40. The front slits 42 at the opposite sides of the wider panel of the shield shell 40 extend partly into the narrower panels of the shield shell 40. Rear edges of the front slits 42 contact the step 30 between the clearance holes 31 when the shield shell 40 is inserted into the housing 20 to limit forward movement of the shield shell 40.

Two laterally spaced locking pieces 43 are formed on each of the wider side panels of the shield shell 40 in a central part of the shield shell 40 along forward and backward directions. The locking pieces 43 extend obliquely in, but are pushed out by the rear edges of the clearance holes 31 when the shield shell 40 is being inserted into the housing 20. The locking pieces 43 are freed from the deformed state when the shield shell 40 is inserted to a specified position and resiliently return to engage locking portions 37 formed at inner sides of the rear edges of the clearance holes 31 and to prevent rearward movement of the shield shell 40.

Resilient pieces 45 are formed unitarily at rear parts of both wider side panels of the shield shell 40 and have substantially the same length as the front slits 42. The resilient pieces 45 are bent in toward the centers of the cavities 23 to have a mountain shape and are arranged near the openings 24A of the supporting frame bodies 24 that form rear parts of the cavities 23 of the housing 20. Contact portions 47 are defined by the peaks of the resilient pieces 45 and contact the connection portion 19B at a rear part of the shell ring 19 when the terminal fitting 10 is inserted into the housing 20. A distance between the opposed contact portions 47 is slightly less than the outer diameter of the shell ring 19 mounted on the shield cable 11. Thus, the connection portion 19B of the shell ring 19 mounted on the shield cable 11 is sandwiched resiliently between by the contact portions 47 of two opposed resilient pieces 45 in an arrangement space for the shell ring 19 in the cavity 23. Thus, the connection portion 19B and the contact portions 47 are connected electrically when the terminal fitting 10 is inserted completely into the cavity 23 of the housing 20. As a result, the shield shell 40 in the housing 20 and the braided wire 17 of the shield cable 11 become electrically connected and the interior is shielded from the shield cable 11 to the housing 20.

A fold 46 is formed at a rear end of each resilient piece 45 so that a folded piece 48 is folded out and then extends substantially straight forward from the fold 46. The leading end of the folded piece 48 is bent in toward the center of the cavity 23 at a position outside the contact portion 47, thereby preventing the contact portion 47 from being pressed excessively out by the shell ring 19.

Each resilient piece 45 has two projections 49 that project laterally from opposite lateral sides of the folded piece 48 at an intermediate position of the folded piece 48 in forward and backward directions. The width of the folded piece 48 including the projections 49 exceeds a distance between the supporting frame bodies 24 of the cavities 23 located at inner sides. Restrictions 38 are formed at edges of the frame bodies 24 and are spaced apart from the projecting pieces 49 by very small clearances. The restrictions 38 contact the projections 49 to prevent the resilient pieces 45 from being resiliently deformed toward the centers of the cavities 23.

Figure 6:
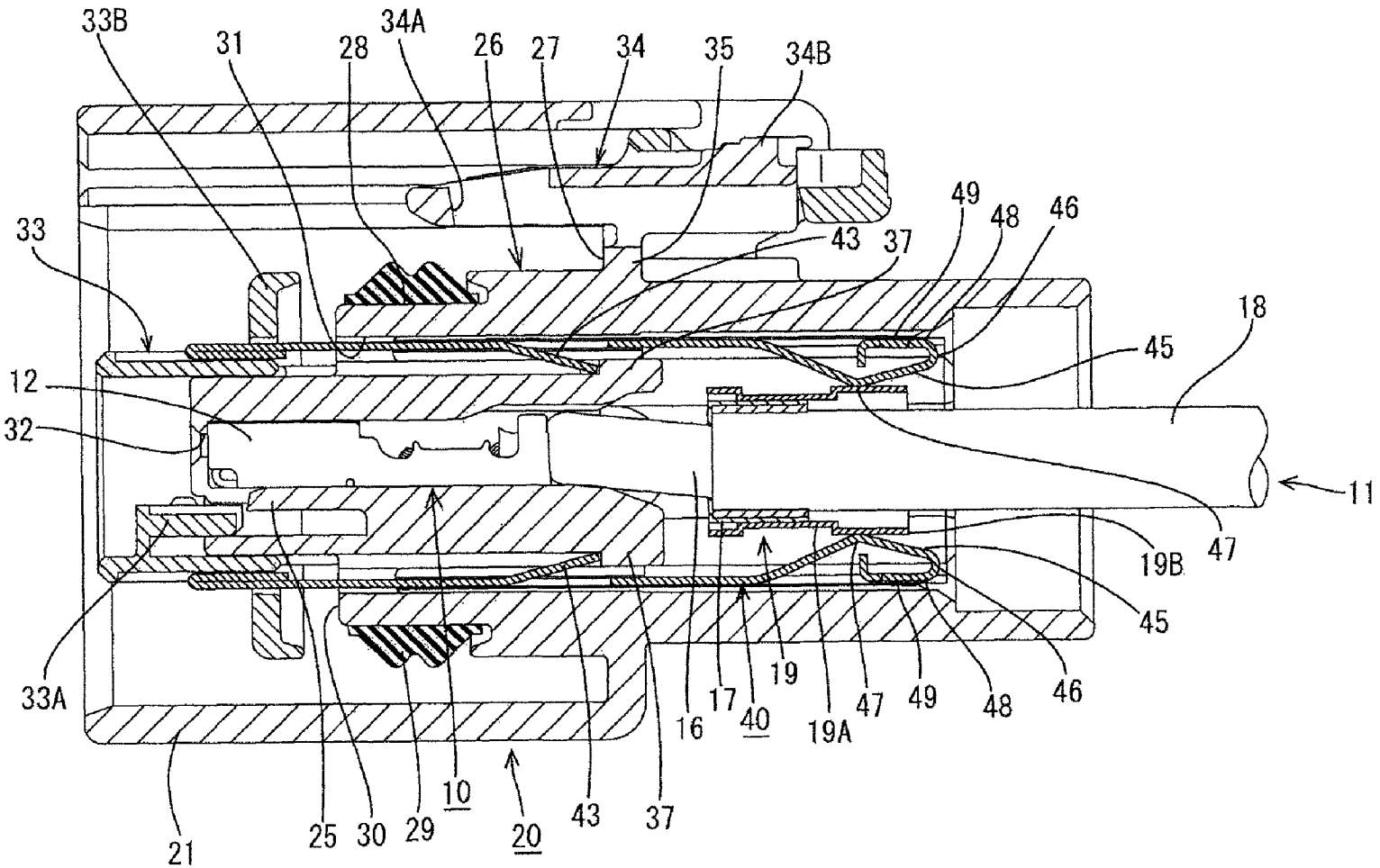
FIG. 6 is a side view in section showing a stale where the terminal fitting is mounted in the housing.
Figure 7:
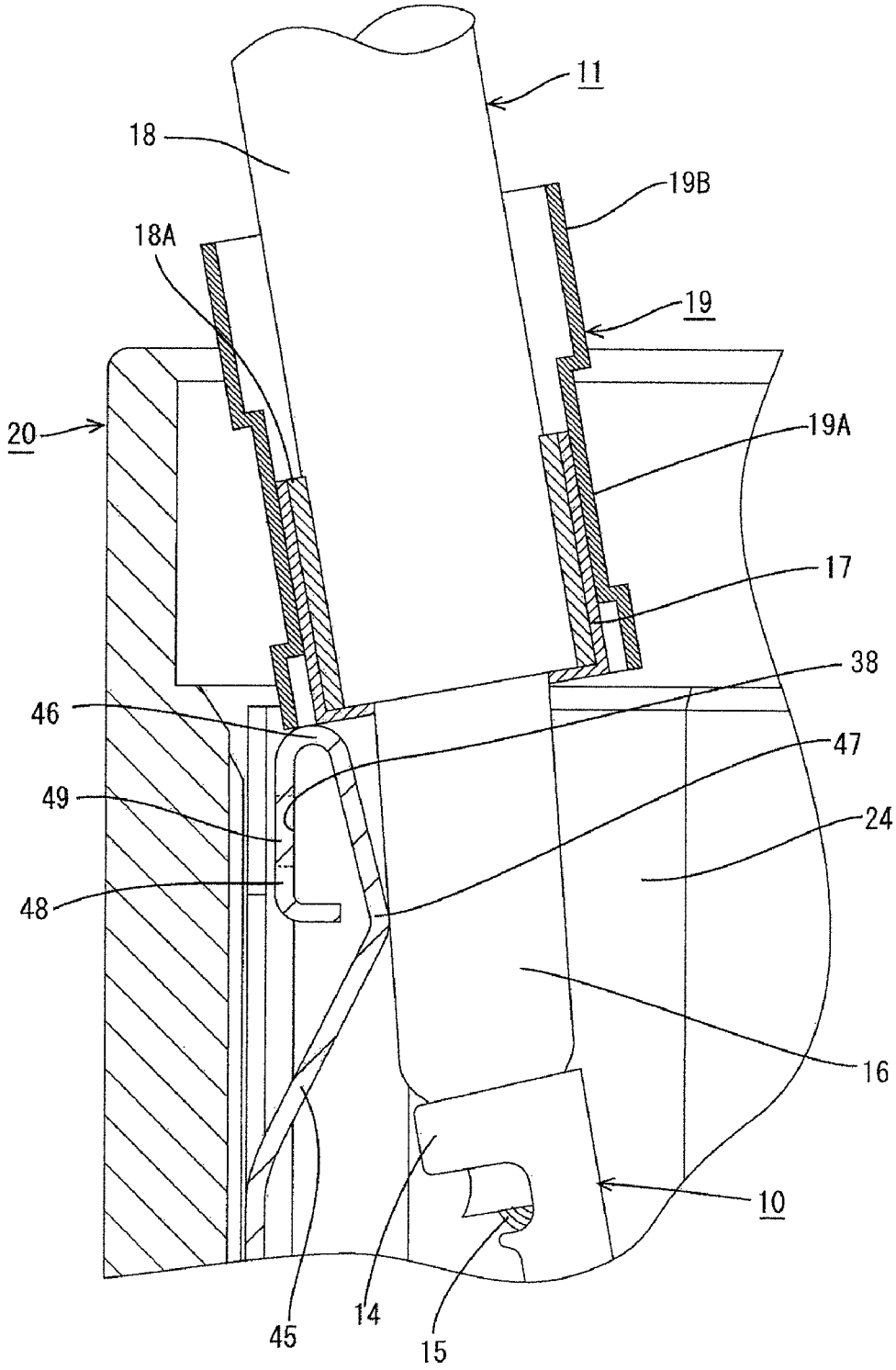
FIG. 7 is a partial enlarged section showing a state where a shell ring is in contact with a resilient piece.
Figure 8:
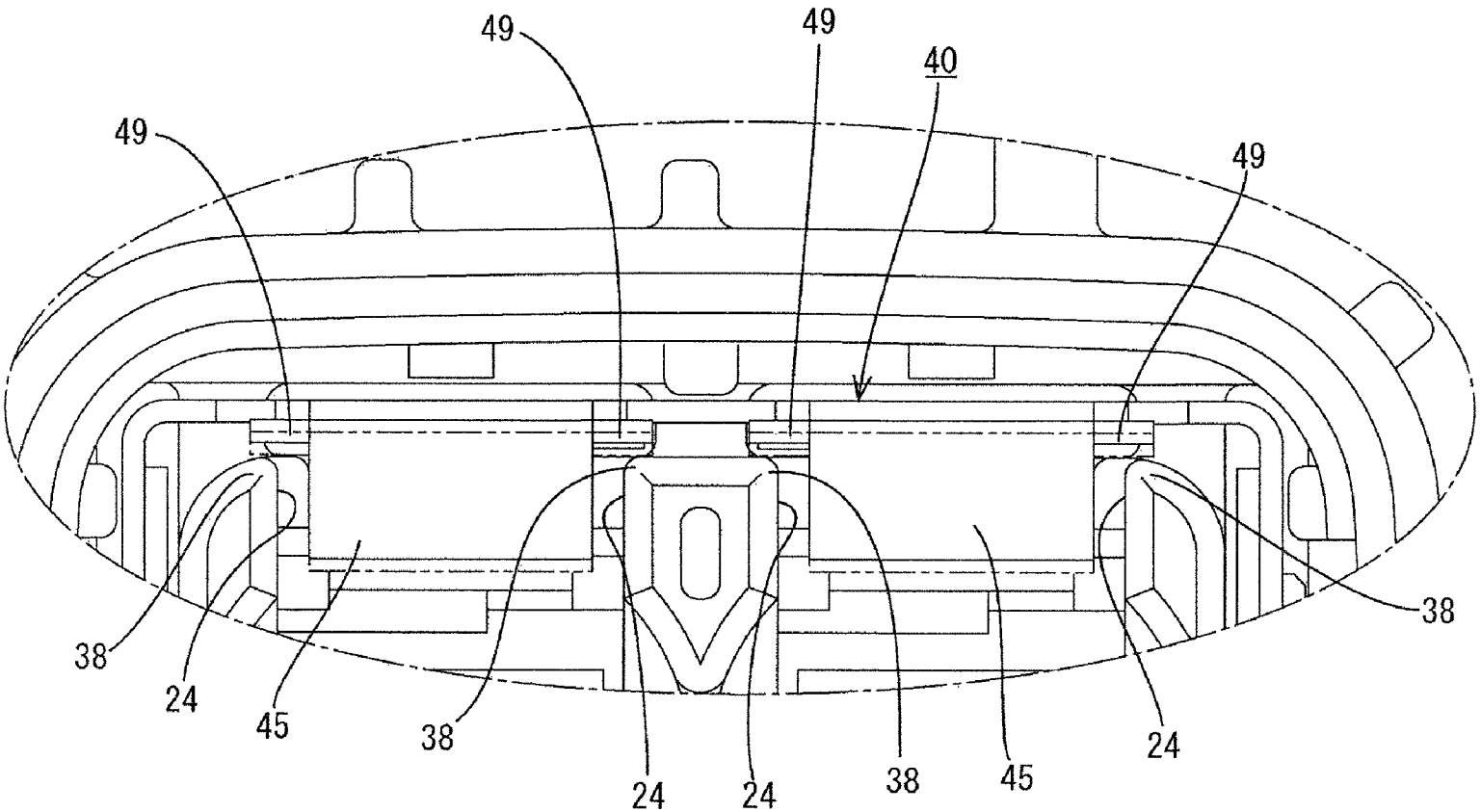
FIG. 8 is a partial enlarged view showing constituent parts of projecting pieces and restricting portions.

The connector is assembled by inserting the terminal fittings 10 into the cavities 23 of the housing 20 through the rear of the housing 20, as shown in FIGS. 6 and 7. However, the terminal fitting 10 could be inserted off center and/or obliquely into the cavity 23. In this situation, the leading end of the terminal fitting 10 or the front end surface of the shell ring 19 may obliquely contact the folded portion 46 of the resilient piece 45 from behind. If the terminal fitting 10 is pushed further to push the resilient piece 45 toward the arrangement space for the shell ring 19, the projections 49 of the folded piece 48 contact the restrictions 38 at a position where the resilient piece 45 is slightly deformed, thereby preventing the resilient piece 45 from being deformed any further. Thus, the resilient piece 45 is prevented from being deformed plastically.

The invention is not limited to the above described and illustrated embodiment. For example, the following embodiments are also included in the technical scope of the present invention.

Although the female terminal fittings 10 are assembled into the housing 20 in the above embodiment, the present invention is also applicable to male terminal fittings.

The leading ends of the folded pieces 48 are bent toward the contact portions 47 in the above embodiment. However, the invention is not limited to such a mode. For example, the leading ends of the folded pieces 48 may extend substantially straight forward. Additionally or alternatively, the folded pieces 48 may have one or more excessive deformation preventing parts (such as one or more embossments) preventing an excessive deformation or displacement of the contact portions 47.

The auxiliary terminal holes 22 are provided in the above embodiment. However, the auxiliary terminal holes 22 need not be provided.

The resilient pieces 45 are formed by bending the rear part of the shield shell 40 to have an inward projecting mountain shape and the folds 46 are formed behind the resilient pieces 45. However, the folds may be bent in and parts extending toward the centers of the cavities from the folded portions may be the resilient pieces.

What is claimed is:

1. A shield connector, comprising:

a housing;

at least one terminal fitting mounted in the housing and to be connected with a shield cable;

at least one conductive shield shell to be accommodated in the housing to substantially surround the terminal fitting and an end portion of the shield cable;

at least one resilient piece extending from the shield shell;

at least one contact portion formed on the resilient piece and contacting a connection portion on a shield portion of the shield cable by mounting the terminal fitting into the housing, at least one touching portion on the resilient piece contacting at least one restricting portion on the housing for preventing the resilient piece from being excessively deformed toward an arrangement space for the connection portion.

2. The shield connector of claim 1, wherein the resilient piece extends substantially back from a rear edge of the shield shell and is folded or bent.

3. The shield connector of claim 2, wherein the touching portion projects from opposite lateral portions of the resilient piece.

4. The shield connector of claim 1, wherein the at least one resilient piece comprises two resilient pieces united with a supporting frame body in the housing and substantially facing each other.

5. The shield connector of claim 4, wherein a distance between the contact portions is slightly less than an outer diameter of a shell ring mounted on the shield cable.

6. The shield connector of claim 5, wherein the connection portion is sandwiched resiliently by the contact portions of the resilient pieces when the terminal fitting is mounted correctly in the housing.

7. The shield connector of claim 1, wherein the resilient piece comprises a folded portion folded back to project from the resilient piece, and a folded piece extending substantially straight forward from the folded portion.

8. The shield connector of claim 7, wherein a leading end of the folded piece is bent toward the contact portion at a position outside the contact portion, thereby preventing the contact portion from being pressed excessively outwardly.

* * * * *